United States Patent [19]

Suzuki

[11] Patent Number: 4,964,833

[45] Date of Patent: Oct. 23, 1990

[54] TOY CONSTRUCTION BLOCKS WITH CONNECTORS

[75] Inventor: Toshio Suzuki, Tokyo, Japan

[73] Assignee: Mass-Set Kabushiki Kaisha, Japan

[21] Appl. No.: 360,606

[22] Filed: Jun. 2, 1989

[51] Int. Cl.[5] ..... A63H 33/08; A63H 33/06

[52] U.S. Cl. ..... 446/118; 446/128; 446/125

[58] Field of Search ..... 446/128, 126, 125, 124, 446/122, 121, 120, 118, 116, 115, 114, 113, 112, 111, 110, 109, 108, 106, 95, 94, 93, 85

[56] References Cited

U.S. PATENT DOCUMENTS

| | | | |
|---|---|---|---|
| 3,233,358 | 2/1966 | Dehm | 446/128 X |
| 3,391,824 | 7/1968 | Wiseman | 446/125 X |
| 3,552,055 | 1/1971 | Matsubayashi et al. | 446/128 |
| 3,962,817 | 6/1976 | Vullierme | 446/128 |
| 4,164,091 | 8/1979 | Lin | 446/128 X |
| 4,306,372 | 12/1981 | Lin | 446/128 X |
| 4,744,780 | 5/1988 | Volpe | 446/128 |

FOREIGN PATENT DOCUMENTS

| | | | |
|---|---|---|---|
| 559934 | 8/1957 | Belgium | 446/128 |
| 629732 | 10/1961 | Canada | 446/128 |
| 1478342 | 2/1969 | Fed. Rep. of Germany | 446/128 |

*Primary Examiner*—Robert A. Hafer
*Assistant Examiner*—Neal L. Muir

[57] ABSTRACT

A toy construction set featuring a base plate with upstanding connecting circular plugs with a plurality of different shaped blocks is disclosed. The blocks have a plurality of shapes to include a square, a half square, a triangle, a circle, and a half circle. The tops of these blocks may have similar plug connectors or may be flat. The underside of the blocks will have a plurality of receptacles to engage plugs underneath. The receptacles will be either ribs converging from the sidewalls or will be a curved portion of the sidewall itself acting to positively engage the plugs beneath, or a combination of both.

21 Claims, 7 Drawing Sheets

TOY CONSTRUCTION BLOCKS WITH CONNECTORS

BACKGROUND OF THE INVENTION

1. Field of the Invention

The present invention relates to toy blocks comprising a base plate having interlocking circular plugs uniformly spaced on the top surface, and a plurality of unit blocks to be interlocked with the interlocking circular plugs.

The unit blocks consist of five shapes including a square, a right triangle, a circle, a one-half circle, and a one-fourth square having one-fourth the top surface area of the above square.

2. Description of the Prior Art

A variety of toy blocks are known as prior art.

Such prior art toy blocks comprise base plates with interlocking circular plugs and unit blocks with a rectangular shaped top surface. The unit blocks interlock with the above interlocking circular plugs of the base plate.

Since the rectangular shaped unit block is a basic shape in the prior art, there are few variations in the manner of arranging the unit blocks on the base plate.

Even if rectangular shaped unit blocks can be interlocked with other shaped unit blocks, the unitary structures of the blocks limit the configurations of the structure which can be built with the toy blocks.

SUMMARY OF THE INVENTION

Toy construction blocks are provided which include a base plate having interlocking circular plugs uniformly spaced on the top surface of the base plate, and various shapes of unit blocks which have one or more concentric rib receptacles and/or circular arc receptacles at the bottom side for receiving the interlocking circular plugs.

The concentric rib receptacle comprises a plurality of rib members disposed along a backside surface of the side of the wall of the unit block to hold the interlocking circular plug.

The circular arc receptacle comprises a circular arc recessed from the side wall of the unit block, wherein the inner circular surface of the arc intersects to the outside surface of the unit blocks.

The top surface of the unit block is defined by interlocking plugs having a cross-section in the shape of a complete and an incomplete circle. The position of the plugs corresponds to the position of the concentric rib receptacles and the circular arc receptacle.

Accordingly, the above unit blocks can be interlocked with the above interlocking circular plugs of the above base plate, and also the unit blocks can be interlocked with other unit blocks.

Alternately, the unit blocks may be provided with a smooth level surface without the interlocking plugs.

Various configurations of the toy blocks are constructed using the base plate and various shapes of the unit blocks.

BRIEF DESCRIPTION OF THE DRAWINGS In the accompanying drawings,

FIGS. 1(*a*) and 1(*b*) respectively show a top plan view and a side elevation view of the base plate.

FIGS. 2(*a*) to 2(*e*) respectively show bottom plan views of the different shapes of the unit blocks of a first embodiment.

FIGS. 3(*a*) to 3(*e*) respectively show bottom plan views of a second embodiment wherein the receptacles are shifted a one-half pitch (one pitch being the distance between opposing side walls) in comparison to the unit blocks in FIGS. 2(*a*) to 2(*e*).

FIGS. 4(*a*) to 4(*c*) respectively show bottom plan views of a third embodiment wherein the receptacles are shifted by one-half pitch further.

FIGS. 8(*a*) to 8(*e*) respectively show top views of the different shapes of the unit blocks shown in FIGS. 2(*a*) to 2(*e*).

Figure 9:
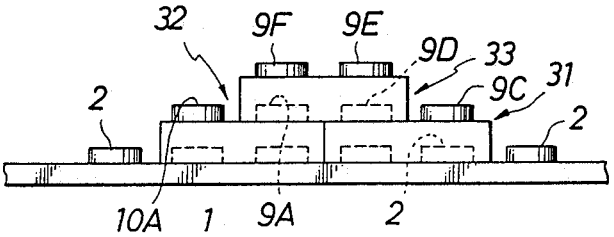

FIG. 9 shows the unit blocks structured on the base plate.

Figure 10:
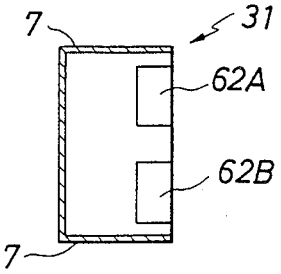

FIG. 10 is a vertical section view of the square unit block having a horizontal smooth top surface of the fourth embodiment.

Figure 11:
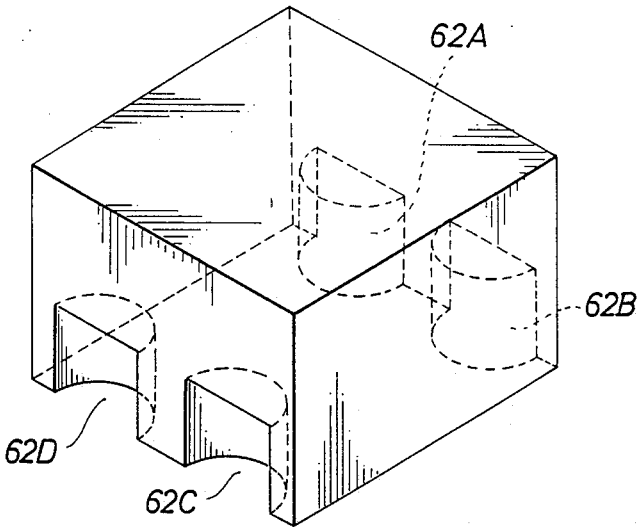

FIG. 11 is a perspective view of the square unit block shown in FIG. 10.

Figure 12:
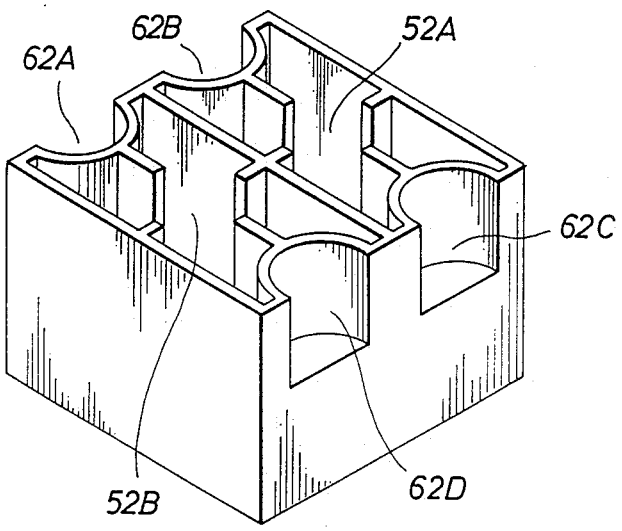

FIG. 12 is a perspective view of the bottom side of the square unit block shown in FIG. 10.

Figure 13:
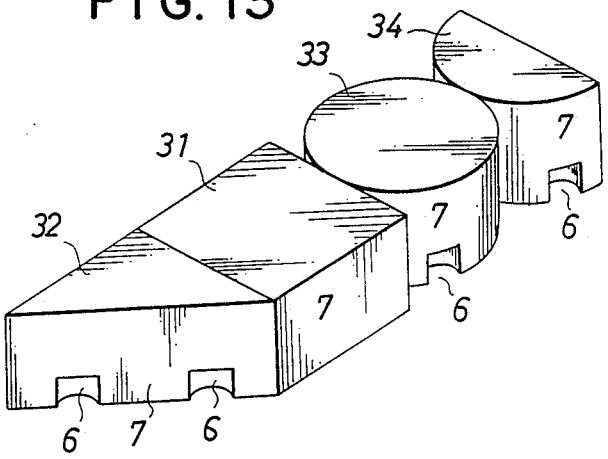

FIG. 13 sows a perspective view showing an arrangement of different shapes of the unit blocks with horizontal smooth top surfaces.

Figure 14:
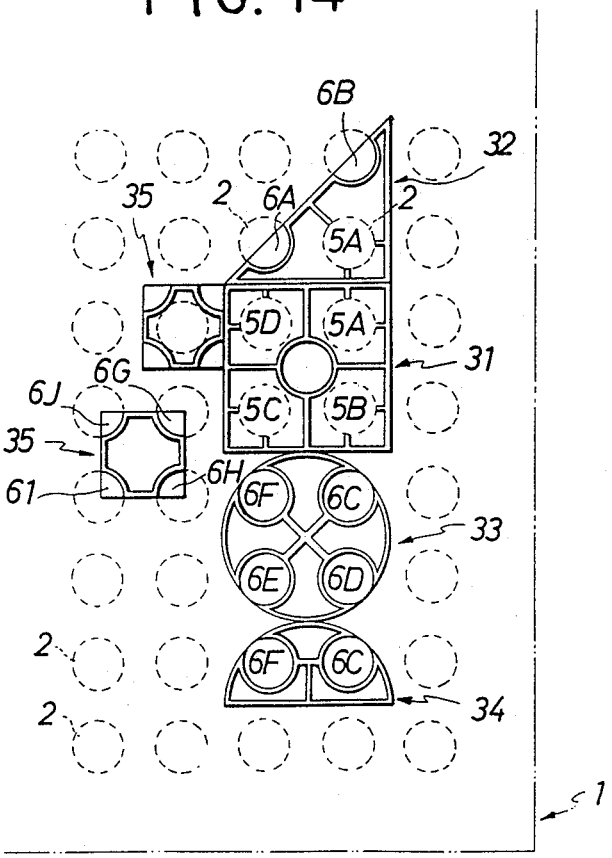

FIG. 14 is a bottom plan view of the different shapes of the unit blocks combined on the base plate.

DESCRIPTION OF THE PREFERRED EMBODIMENTS

Referring to the drawings, FIG. 1 to FIG. 14, the preferred embodiments of the toy blocks of the present invention are explained as follows:

The toy blocks comprise the base plate 1 having interlocking circular plugs 2 on the top surface, and the unit blocks comprising five different shapes of the unit block all having one or more concentric rib receptacles 5 and circular arc receptacles 6 at the bottom side thereof, said receptacles interlocking with the interlocking circular plugs 2.

Figure 1:
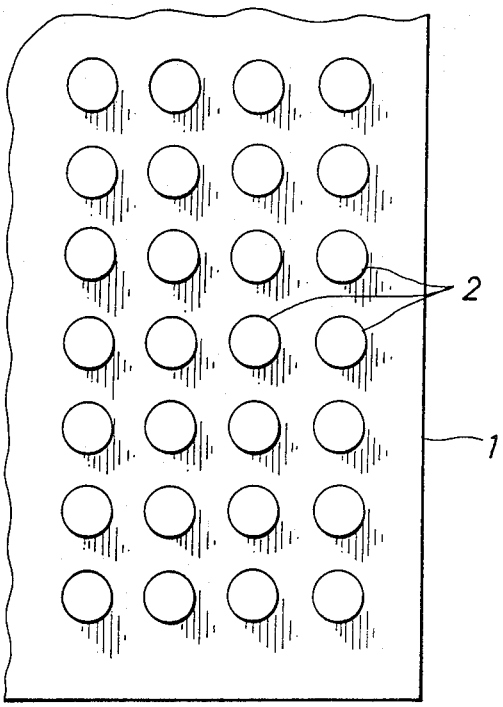
Figure 1B:
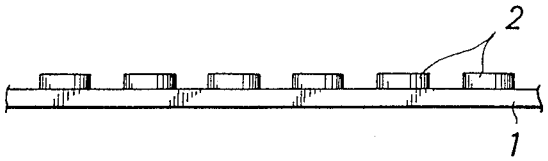
Figure 2A:
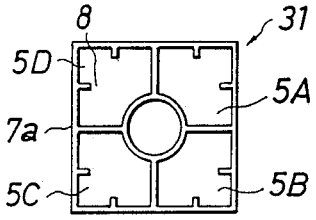
Figure 2B:
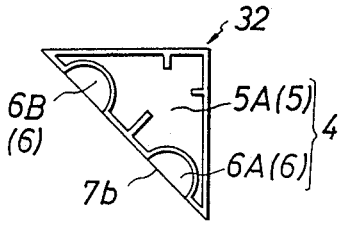
Figure 2C:
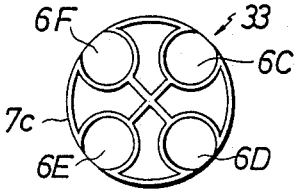
Figure 2D:
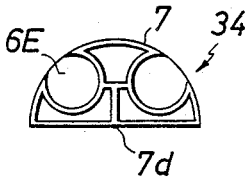
Figure 2E:
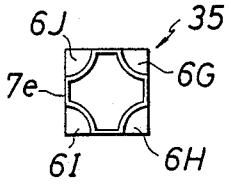
Figure 3A:
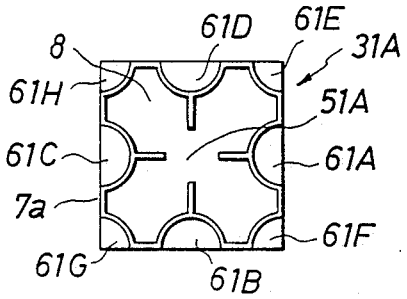
Figure 3B:
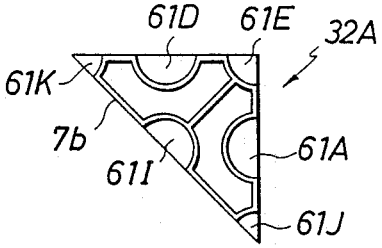
Figure 3C:
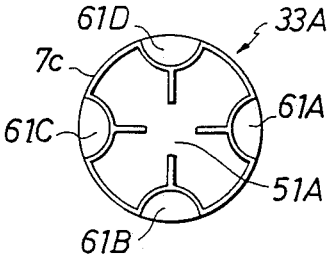
Figure 3D:
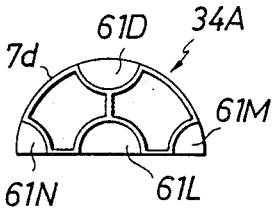
Figure 3E:
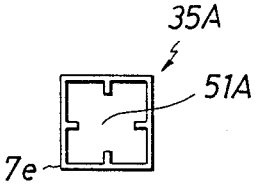

The base plate 1 is made of plastic and is shaped as a shallow box which is open at the bottom, and it is provided with many interlocking circular plugs 2 uniformly spaced on its top surface, as shown in FIG. 1.

The interlocking circular plugs 2, as well known, are shaped as round plugs projecting vertically upward from the top surface of the base plate 1, and are uniformly spaced thereon.

The unit blocks 3 comprise a variety of shapes as shown in the embodiments of FIG. 2 to FIG. 14.

The five basic shapes of the unit blocks 3 comprise a square, a right triangle, a circle, a one-half circle, and a one-fourth square with a top surface area which is one-fourth that of the above-mentioned square.

The unit blocks 3 are provided with two horizontally opposed top and bottom planes and a side wall 7 abutting the periphery of the top and bottom planes and extending vertically perpendicularly from the edge of the top and bottom surface.

Referring to FIGS. 2(*a*) to 2(*e*), the first embodiment of the invention is described as follows:

The square unit block 31 is shaped as a right square from a top view, as shown in FIG. 2(*a*).

The right triangular unit block 32 is sectioned along the diagonal line of the top surface of the above square unit block 31, as shown in FIG. 2(*b*).

The circular unit block 33 is composed of a circle having a diameter equal to one side of the top surface of the square unit block 31, as shown in FIG. 2(*c*).

The one-half circular unit block 34 is obtained by sectioning vertically the above circular unit block 33 along its axis so as to include the circular arc receptacles 6C and 6F, as shown in FIG. 2(*d*).

The small square unit block 35 has a top surface area one-fourth the size of the above-mentioned square unit block 31, as shown in FIG. 3(*e*).

All of the bottom sides 8 of the unit blocks 31 to 35 are opened so that the plug interconnections can be provided.

In the bottom side openings of the unit blocks two types of interconnecting receptacles are provided to be interlocked with the interlocking circular plugs 2 of the base plate 1.

One type of receptacle is a concentric rib receptacle 5, and the other is a circular arc receptacle 6, both of which are interlocked with the interlocking circular plugs 2.

The concentric rib receptacle 5 comprises a plurality of concentric ribs extending vertically from the top surface of the unit block to the base so as to hold the outside surface of the above interlocking circular plugs 2 between plural inside edges of the concentric ribs and/or a backside surface of the circular arc receptacles 6 or the side walls 7 of the unit blocks 31.

Figure 4A:
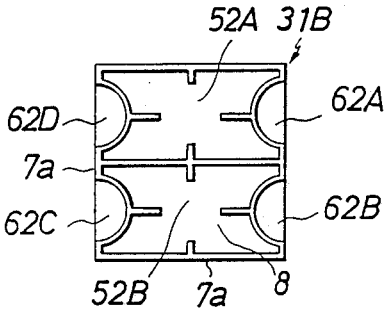
Figure 4:
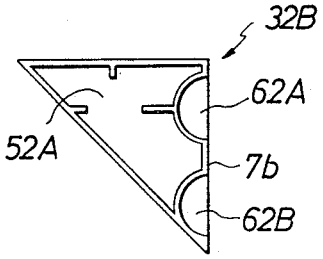
Figure 4C:
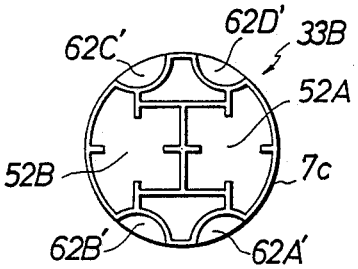
Figure 4D:
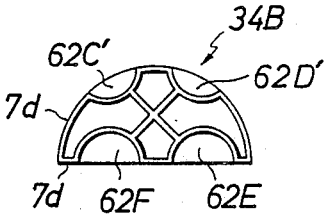
Figure 4E:
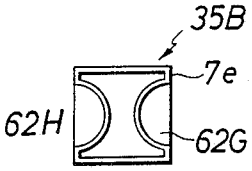
Figure 5:
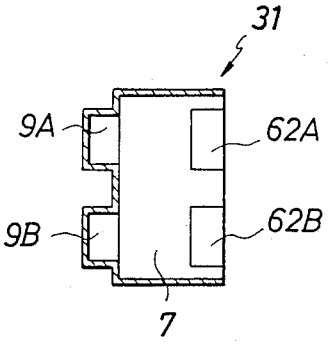
FIG. 5 is a vertical section view of the square unit block shown in FIG. 4(*a*).
Figure 6:
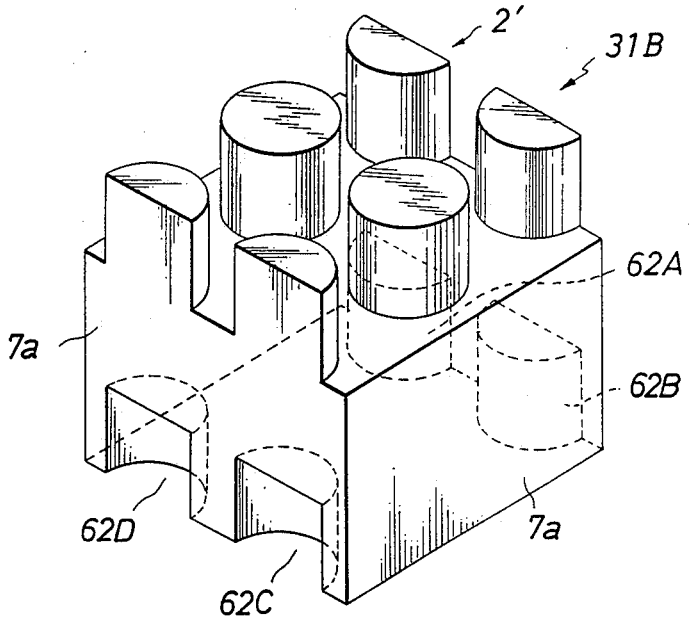
FIG. 6 is a perspective view of the square unit block shown in FIG. 4(*a*).
Figure 7:
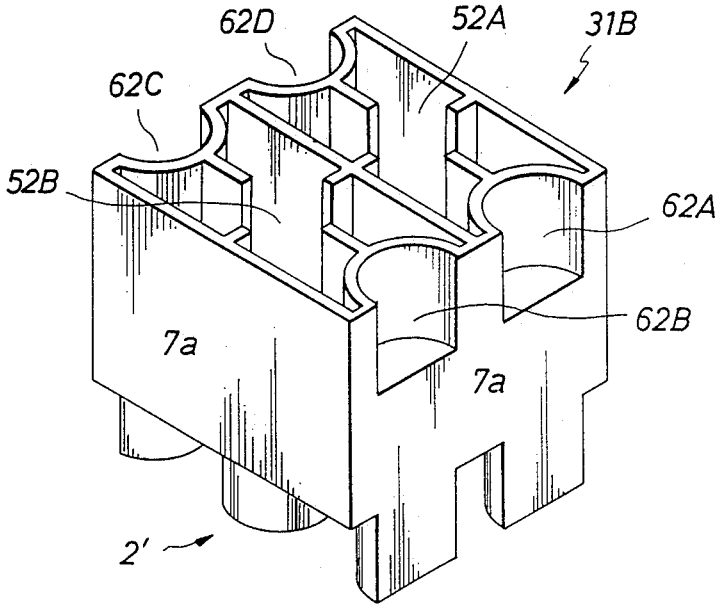
FIG. 7 is a perspective view of the bottom side of the square unit block shown in FIG. 4(*a*).
Figure 8A:
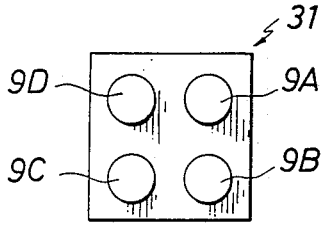
Figure 8B:
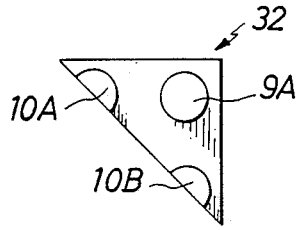
Figure 8C:
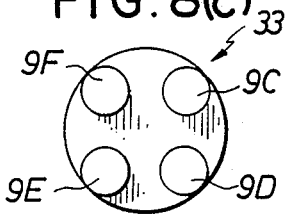
Figure 8D:
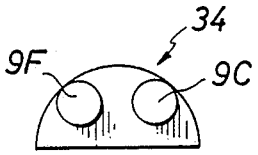
Figure 8E:
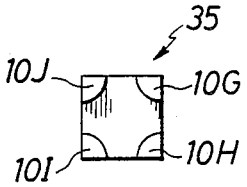

The backside of the circular arc receptacles 6 or the side wall 7 of the unit block 31 are used for the plug interconnections in the case shown in FIG. 2(*a*), FIG. 2(*e*), and FIG. 4(*b*).

With the concentric rib receptacles 5, the outside surface of the interlocking circular plugs 2 is entirely included within the side wall 7 from a top view of the unit blocks 31.

On the other hand, with the circular arc receptacle 6 the circular outer surface of the interlocking circular plug 2 is partially included within the side wall 7 of the unit block 31.

That is, interlocking circular plugs 2 project from the surface of the outside wall 7.

The latter circular arc receptacle 6 comprises a circular arc wall inwardly recessed from the side wall 7, and the inner surface of the circular arc receptacles 6 are continuous with the outside surface of the side wall 7 of the unit blocks 31.

The circular arc of the circular arc receptacle 6 is formed to receive the interlocking circular plug 2.

It is preferable that the depth of the concentric rib receptacles 5 and the circular arc receptacles 6 are at least equal to or greater than the height of the interlocking circular plugs 2.

The ribs of concentric rib receptacles 5 extend vertically downward from the top surface of the unit block and terminate even with the bottom base, and also extend inward for interconnection with the interlocking circular plugs 2.

Two types of the above interconnecting receptacles are established based on the position of the plug interconnection to be interlocked with the interlocking circular plugs 2.

The arrangement of the position of the concentric rib receptacles 5 and the circular arc receptacles 6 are decided according to the shapes of the unit blocks 3 as shown in FIG. 2 to FIG. 4.

The bottom view of the square unit blocks 31 is shown in FIG. 2(*a*).

In the center of the square unit block 31 a cylindrical rib extends vertically, and four concentric rib receptacles 5A, 5B, 5C, 5D are arranged symmetrically at 90° intervals with respect to the center of the square. Therefore, the interlocking plugs 2 are enclosed within the side wall 7 of the square unit block 31.

In this case the interlocking circular plugs 2 are held between the edge of the concentric ribs extending from the side wall 7 and the backside of the cylindrical rib, as shown in FIG. 2(*a*).

Based on the concentric rib receptacle positions 5A, 5B, 5C, 5D in the above square unit block 31, the positions of the concentric rib receptacles 5 and the circular arc receptacles 6 of the other unit blocks 32 to 35 can be established.

The right triangular unit block 32, as shown in FIG. 2(*b*), has one concentric rib receptacle 5A corresponding to the concentric rib receptacles 5A of the square unit block 31 at the right angle portion, and two half circular arc receptacles 6A, 6B recessed in the oblique side wall 7 of the unit block 7.

The half circular arc receptacles 6A, 6B are located in the positions corresponding to the interconnecting positions 5B, 5D of the square unit block 32, as shown in FIG. 2(*b*).

The top view of circular unit block 33 is defined by a circle having a diameter equal to one side of the square unit block 31, as shown in FIG. 2(*c*).

The circular unit block 33 is provided with four circular arc receptacles 6C, 6D, 6E, 6F in positions respectively corresponding to the above concentric rib receptacles 5A, 5B, 5C, 5D of the square unit block 31.

The circular unit block 33 comprises a column which has the same axis as the square unit block 31, and a circular top surface having a diameter equal to one side length of the square. The circular inner surface of the circular arc receptacles are continuous to the outside surface of the outside walls 7, as shown in FIG. 2(*c*).

The position of the circular arc receptacles 6C, 6D, 6E, 6F respectively correspond to the position of the concentric rib receptacles 5A, 5B, 5C, 5D of the square unit blocks 31.

The one-half circular unit block 34 is obtained by vertically sectioning the above circular unit block 33 along its axis so as to symmetrically include two receptacles, as shown in FIG. 2(*d*).

Accordingly, the same circular arc receptacles 6C, 6F are provided at the circular outside wall 7 of the unit block 34.

The one-fourth square unit block 35 has a top surface area one-fourth the magnitude of the above square unit blocks 31. The one-fourth square unit block also has four one-fourth circular arc receptacles 6G, 6H, 6I, 6J at four corners of the one-fourth square unit block respectively, and one concentric rib receptacle 8G in the center of the unit block Modified embodiments of the invention are seen in FIGS. 3(*a*) to 3(*e*) and FIGS. 4(*a*) to 4(*e*). These are the second and the fourth embodiments, respectively.

The second embodiment showing the different position of the concentric rib receptacles 5 and the circular arc receptacles 6 is shown in FIGS. 3(*a*) to 3(*e*).

In the second embodiment shown in FIGS. 3(*a*) to 3(*a*) to 3(*e*), the position of the circular arc receptacles 6 and concentric rib receptacle 5 are shifted longitudinally or laterally one-half pitch away (a pitch being one-half the distance between opposing points on the side wall) from the arrangements shown in FIGS. 2(*a*) to 2(*e*).

That is, the square unit block 31A, as shown in FIG. 3(*a*), is provided with one concentric rib receptacle 51A in the center of the unit block 31A.

The interlocking circular plug 2 is held by the inner edges of four ribs of the concentric ribs extending inward to the center of the unit blocks 31A.

The half circular arc receptacles 61A, 61B, 61C, 61D are provided in the middle of respective side walls *7a*.

Also, at each of the four corners of the square unit block 31A a one-fourth circular arc receptacle 61E, 6F, 6G, 61H is provided, as shown in FIG. 3(*a*).

In both the first and the second embodiment, two types of the interconnecting receptacles (the concentric rib receptacles 5 and the circular arc receptacle 6) are provided.

Based on the position of the concentric rib receptacle 51A and the circular arc receptacle 61A to 6H of the square unit blocks 31A, the positions of the concentric rib receptacles 5 and the circular arc receptacles 6 of the other shaped unit blocks 32A, 33A, 34A, 35A can be established.

That is, the right angled triangle unit block 32A is provided with half circular arc receptacles 61A, 61I, 61D recessed in the center of respective side walls and the circular arc receptacle 61E at the right angle corner, and the one-eight circular arc receptacles 61J, 61K and the other angle corners corresponding to the interconnecting positions of the above square unit block 31A, as shown in FIG. 3(*b*).

Accordingly, when mating the triangular unit block 32A with a similar block such that the oblique sides are contiguous, the same plug interconnection is obtained as in the case of the square unit blocks 31A, which is also interconnected with four interlocking circular plugs 2.

The circular unit block 33A is provided with the concentric rib receptacles 51A symmetrically disposed about the center axis, and the one-half circular arc receptacles 61A, 61B, 61C, 61D, are arranged on the circular outside wall *7c* at 90 degree intervals with respect to the axis, as shown in FIG. 3(*c*). The one-half circular unit block 34A is provided with one-half circular receptacles 61D centered in the middle of the circular side wall *7d* and in the straight side wall *7d*. One-quarter circular receptacles 61M, 61N are disposed at two corners, as shown in FIG. 3(*d*).

The one-fourth square unit block 35A is provided with the concentric rib receptacles 51A extending from the center of respective side walls of the one-fourth square block unit.

Each rib of the concentric rib receptacle 51A is extending toward the center of the one-quarter square unit block 35A from the center of each side wall *7e* so that the interlocking circular plugs 2 can be held by the edge of the ribs in the center of the unit block 35A, as shown in FIG. 3(*e*).

The third embodiment of the invention is shown in FIGS. 4(*a*) to 4(*e*).

In the case of the plug interconnection of this embodiment the position of the concentric rib receptacle 52 and the circular arc receptacle 62 are shifted longitudinally or laterally one pitch from the arrangement shown in FIGS. 2(*a*) to 2(*e*).

The square unit block 31B is partitioned equally into two rectangles by one straight rib bisecting the outside rim at opposing sides of the block, as shown in FIG. 4(*a*).

The concentric rib receptacles 52A, 52B are respectively provided in the central positions of the above rectangles.

Half circular arc receptacles 62A, 62B, 62C, 62D are provided in the middle of each side wall *7a* of each of the above rectangles, as shown in FIG. 4(*a*).

Based on the position of the concentric rib receptacles 52A and the circular arc receptacles 62A, 62D of the square unit block 31B, the position of the concentric rib receptacles 5 and the circular arc receptacles 6 of the other shaped unit blocks can be decided.

The right triangular block 32B is provided with the concentric rib receptacle 52A corresponding to the position of the circular arc receptacle 52A of the square unit block 31B, and the circular arc receptacles 62A, 62B recessed in the side wall 7 correspond to the circular arc receptacles 62A, 62B of the square unit block 31B.

The interlocking circular plug 2 interlocks with the concentric rib of concentric rib concentric ribs receptacle 52A and the backside of the oblique side wall *7b* of the unit block 32B.

The circular unit block 33B comprises a column which has a circular cross-section having a diameter equal to one side length of the top square surface of unit block 31B.

Accordingly, when mating the triangle unit block 32B with a similar triangle unit block 32B such that the oblique sides are contiguous, the same plug interconnections are obtained as in the case of mating square unit blocks 31B.

The circular unit block 33B is provided with concentric rib receptacles 52A, 52B in positions corresponding to those of the above square unit blocks 31B. Also, four circular arc receptacles 62A', 62B', 62C', 62D' are provided at four points along the outside wall equidistant from the two points where the center line intersects with the circle of the outside wall *7c*.

The one-half circular unit block 34B is a half column block which is symmetrically sectioned vertically along the center line so as to include the circular arc receptacles 62C', 62D' in a one-half unit block 34B.

The half circular arc receptacles 62E, 62F are provided at the side wall *7d* in the position corresponding to the above concentric rib receptacles 52A and 52B of the square unit block 31B.

The one-fourth square unit block 35B has a top surface area which is one-fourth the magnitude of the square unit block 31B. The one-fourth square unit block 35B is provided with the half circular arc receptacles 62G, 62H recessed in 5 the middle of opposing side walls, as shown in FIG. 4(*e*).

In the first to the third embodiment interlocking plugs 2' are provided on the top surface of the unit blocks as shown in FIG. 5 to FIG. 9.

From a top view, the interlocking plugs 2' comprise a complete circular plug and an incomplete circular plug.

Referring to FIGS. 8(*a*) to 8(*e*), complete circular plugs 9A to 9F and incomplete circular plugs 10A, 10B, 10G to 10J are provided on the top surface at positions corresponding to the circular arc receptacles at the bottom side.

Therefore, the interlocking plug 2' on a unit block can be fitted to the corresponding circular arc receptacles of other unit blocks.

Top plan views of the unit blocks of FIGS. 3(*a*) to 3(*e*) and 4(*a*) to 4(*e*) are not shown, but similar interlocking plugs 2' are provided on the top surface of the unit blocks shown in FIGS. 3(*a*) to 3(*e*) and FIGS. 4(*a*) to 4(*e*).

FIG. 9 shows the side view of one example of a structure of toy blocks interlocked in which the square unit blocks 31 are interlocked on the other unit blocks. Thus unit blocks can be piled up on other unit blocks as well as the base plate 1.

The fourth embodiment of the present invention is shown in FIG. 10 to FIG. 13.

The only different point from the above first to third embodiments is that all of the top surfaces of the unit blocks are level smooth surfaces.

One example of the unit blocks of the fourth embodiment is shown in FIG. 13, wherein interlocking plugs 2' shown in the first embodiment of FIGS. 2(*a*) to 2(*e*) are replaced by the level smooth top surfaces.

In the fourth embodiment the unit blocks which are provided with level smooth top surfaces have identical arrangements of the concentric rib receptacles and circular arc receptacles as shown in FIGS. 3(*a*) to 3(*e*) and FIGS. 4(*a*) to 4(*e*), respectively.

Since these unit blocks are easily analogized, the figures for illustrating them are omitted.

Since the other constructions of the unit blocks and the base plates are identical to the previously described first to third embodiment, the explanations for the like construction are omitted.

The arrangement pattern of the unit block 3' is not limited to the above arrangement shown in FIG. 13, but a new level smooth surfaces are obtained by using a plurality of similarly shaped unit blocks having plug interconnecting positions shifted one pitch or one-half pitch, with respect to the position of the concentric rib receptacles 5 and circular arc receptacle 6 of the square unit block 31 in FIG. 2(*a*).

FIG. 14 shows one example of constructions of the toy block, interlocking five shapes of the unit blocks on the base plate 1.

As described above, the construction pattern of the toy block is obtained by using different or the same shapes of the unit blocks.

Accordingly, various shapes of the unit blocks can be interlocked on the base plate 1 next to other unit blocks, and the new top surface having interlocking plugs 2' interlocked with other unit blocks in the same manner that the unit blocks are interlocked with the top surface of the base plate 1.

The construction pattern of the toy block is not limited to the above construction pattern shown in FIG. 14, but the unit blocks 3 can be shifted longitudinally and/or laterally one or one-half pitch, on the basis of the arrangements of the concentric rib receptacle 5 or circular arc receptacle 6, as shown in FIG. 2.

What is claimed is:

1. A toy construction block set, comprising:

a base plate with a plurality of interlocking circular plugs having a concentric outside surface, said plugs being uniformly spaced on a top surface of the base plate;

a plurality of unit blocks in the shape of a square, a triangle, a circle, a one-half circle, and a one-fourth square having a top surface area one fourth that of said square, said unit blocks each provided with a horizontally disposed top planar surface, a peripheral side-wall extending perpendicularly from said top planar surface and having an upper edge conterminous therewith, and a bottom base circumscribed by a lower edge of said peripheral side-wall, said unit blocks each having at least one interlocking receptacle in the bottom base, whereby some of said unit blocks have a concentric rib receptacle comprising a plurality of concentrically spaced ribs for interconnection with said interlocking circular plugs so that the outside surface of the plugs is entirely enclosed within the peripheral side-wall of the unit blocks when the interlocking circular plugs are interconnected, and some of said unit blocks have a circular arc receptacle comprising a circular arc inner surface for interlocking with the outside surface of said interlocking circular plugs, said circular arc inner surface converging on said peripheral side-wall of the unit block and contiguous therewith so that an interconnected circular plug extends outward past said peripheral side-wall and outside the unit block, and others of said unit blocks have said concentric rib receptacle and said circular arc receptacle.

2. The toy construction block set according to claim 1, wherein a square unit block is provided with a plurality of concentric rib receptacles at the bottom planar surface symmetrically positioned at 90 degree intervals with respect to a center of said surface, and wherein the receptacles of the other unit blocks are positioned in accordance with the position of the receptacles of the square unit block.

3. The toy construction block set according to claim 1, wherein a triangular unit block has the same dimensions as a section of the square unit block defined by vertically halving the square unit block along a transverse plane, said triangular unit block having one concentric rib receptacle positioned adjacent to the orthogonal corner of the bottom planar surface, and two circular arc receptacles positioned along the peripheral side-wall, the positions of said receptacles corresponding to the position of the receptacles of the square unit block.

4. The toy construction block set according to claim 1, wherein a circular unit block comprises a column with a diameter equal to the length of one side of the square unit block, said circular unit block having four circular arc receptacles along the bottom planar surface at the peripheral side-wall of the circular unit at a position corresponding to the position of the receptacles of the square unit block.

5. The toy construction block set according to claim 1, wherein a one-half circular unit block has the same dimensions as a section of the circular unit block defined by vertically halving the circular unit block along an axis, said one-half circular unit block having two circular arc receptacles at the bottom planar surface positioned along the peripheral side-wall at a position corresponding to the position of the receptacles of the square unit block.

6. The toy construction block set according to claim 1, wherein a one-fourth square unit block has the same dimensions as a section of said square unit block defined by vertically quartering the square unit block, said one-fourth unit block having four circular arc receptacles at the bottom planar surface positioned adjacent to the four corners of the one-fourth square unit block, respectively.

7. The toy construction block set according to any one of claims 2–6 or 10–14, wherein the positions of the receptacles of the unit blocks are shifted one pitch relative to the position of the corresponding receptacles of the square unit block.

8. The toy construction block set according to claim 1, wherein a square unit block is provided with a plurality of concentric rib receptacles at the bottom base symmetrically positioned at 90 degree intervals with respect to a center of said surface, and an interlocking plug is provided on the top surface of the unit block.

9. The toy construction block set according to any one of claims 8 or 17–20, wherein the positions of the receptacles of the unit blocks are shifted one pitch relative to the position of the corresponding concentric rib receptacle and circular arc receptacle of the square unit block.

10. The toy construction block set according to claim 2, wherein at least one square unit block is provided with a smooth horizontal surface on the top planar surface.

11. The toy construction block set according to claim 3, wherein at least one triangular unit block is provided with a smooth horizontal surface on the top planar surface.

12. The toy construction block set according to claim 4, wherein at least one circular unit block is provided with a smooth horizontal surface on the top planar surface.

13. The toy construction block set according to claim 5, wherein at least one one-half circular unit block is provided with a smooth horizontal surface on the top planar surface.

14. The toy construction block set according to claim 1, wherein the one-fourth square unit block has the same dimensions as a section of said square unit block defined by vertically quartering the square unit block said one-fourth unit block having a concentric rib receptacle positioned along the bottom planar surface in the center of the one-fourth square unit block.

15. The toy construction block set according to claim 6 or 18, wherein at least one one-fourth square unit block is provided with a smooth horizontal surface on the top planar surface.

16. The toy construction block set according to any one of claims 2–6 or 10–14, wherein the positions of the receptacles of the unit blocks are shifted one-half pitch relative to the position of the corresponding concentric rib receptacle and circular arc receptacle of the square unit block.

17. The toy construction block set according to claim 3, wherein at least one of said triangular unit blocks is provided with an interlocking plug on the top planar surface.

18. The toy construction block set according to claim 4, wherein at least one of said circular unit blocks is provided with an interlocking plug on the top planar surface.

19. The toy construction block set according to claim 5, wherein at least one of said one-half circular unit blocks is provided with an interlocking plug on the top planar surface.

20. The toy construction block set according to claim 6, wherein at least one of said one-fourth square unit blocks is provided with an interlocking plug on the top planar surface.

21. The toy construction block set according to any one of claims 8 or 17–20, wherein the positions of the receptacles of the unit blocks are shifted one-half pitch relative to the position of the corresponding receptacles of the square unit block.

* * * * *